United States Patent [19]

Link et al.

[11] Patent Number: 4,867,279

[45] Date of Patent: Sep. 19, 1989

[54] LOW-PROFILE RAILWAY CAR RETARDER

[75] Inventors: Charles T. Link, Pleasant Hills; Bennie M. Gray, Pittsburgh; Harold L. Shumaker, Monroeville, all of Pa.

[73] Assignee: American Standard Inc., Swissvale, Pa.

[21] Appl. No.: 297,680

[22] Filed: Aug. 31, 1981

Related U.S. Application Data

[63] Continuation of Ser. No. 105,326, Dec. 19, 1979, abandoned.

[51] Int. Cl.[4] ..... B61K 7/02; B61B 1/00

[52] U.S. Cl. ..... 188/62; 104/26.2

[58] Field of Search ..... 188/62; 104/26.2; 246/182 A

[56] References Cited

U.S. PATENT DOCUMENTS

| | | | |
|---|---|---|---|
| 1,927,201 | 9/1933 | Bone | 188/62 |
| 1,942,513 | 1/1934 | Livingston | 188/62 |
| 1,996,139 | 4/1935 | Bone | 188/62 |
| 2,014,551 | 9/1935 | Bone et al. | 188/62 |
| 2,089,823 | 8/1937 | Bone | 188/62 |
| 2,326,924 | 8/1943 | Bone | 188/62 |
| 2,559,392 | 7/1951 | Bone | 188/62 |
| 3,196,985 | 7/1965 | Rowe et al. | 188/62 |
| 3,519,107 | 7/1970 | Bellinger | 188/62 |

*Primary Examiner*—Robert J. Oberleitner

*Attorney, Agent, or Firm*—Buchanan Ingersoll; George P. Baier

[57] ABSTRACT

A low-profile railway car retarder having a pair of braking bars disposed parallel and on opposite sides of a track rail and having an upper and lower pivotal lever carrying a respective one of the pairs of braking bars. A pneumatic motor pivotally connected to the outer extremities of the upper and lower levers, and the height of the pivotal connection of the upper lever is substantially at the same level as the track rail so that a humped railway vehicle is permitted to freely pass through the car retarder. The pneumatic motor lifts the upper lever and depresses the lower lever to move the pair of braking bars to a closed braking position wherein pressure is supplied to the pneumatic motor so that the pair of braking bars engage the opposite side of the wheels of a traversing vehicle at a relatively high point to exert a greater amount of retardation of the vehicle.

11 Claims, 2 Drawing Sheets

LOW-PROFILE RAILWAY CAR RETARDER

This application is a continuation of copending application, Ser. No. 105,326, filed Dec. 19, 1979, now abandoned.

FIELD OF THE INVENTION

This invention relates to railway braking apparatus and, more particularly, to a railroad pneumatically operated railroad car retarder employing a pair of braking bars disposed parallel to the track rail which are carried by a pair of respective pivoted levers that are opened and closed by a pneumatic pressure piston-cylinder actuator having increased braking effort to provide greater retardation, having a low-profile design to provide more vehicle clearance, and having an improved brake shoe wear and lever spring stop adjusting features.

BACKGROUND OF THE INVENTION

In certain railroad operations, such as, in a classification processing yard, the railway cars or vehicles of incoming trains are sorted or classified in accordance with consist and destination in a given one of a plurality of class or receiving tracks. In hump types of classification yards, it is necessary to control the velocity or speed of the free-rolling vehicles by suitable braking apparatus. Generally, the braking apparatus takes the form of power operated frictional car retarders having braking bars which engage and grip the sides of the passing wheels of the humped railway vehicles. It will be appreciated that the amount of retardation or braking effort which is exerted on the passing wheels by the ar retarder is dependent upon the rollability and the distance that the humped vehicle or cut of vehicles have to travel to safely couple with the foregoing vehicle in the appropriate class track. It has been found that the most effective retardation occurs when the frictional braking force is applied to a relatively high point on the sides of the car wheels. The ensuing benefits of higher wheel contact braking results in the ability to construct and utilize shorter car retarders in the classification yards. It will the car retarder not only reduces the initial manufacturing costs but also results in the more economical use of the available space of the yard since the required length of the approach track is proportionally reduced. Further, it has been found that the leading edges, corner sill portions, or side ladders on locomotives and/or vehicles hit the upper levers and cause damage to the vehicles and retarders. Further, since some humped cars were unable to clear and freely pass through the existing car retarders, the amount of retardation was not always accurately controlled. Thus, it would be highly advantageous to provide a low-profile car retarder to allow the unimpeded passage of the locomotives and particularly, the humped cars. An additional problem in conventional braking apparatus resides in the difficulty in making the necessary adjustments for brake shoe wear and lever stopping. Thus, it is desirable to provide a simple time-saving method of brake shoe and stop adjustment.

OBJECTS AND SUMMARY OF THE INVENTION

Accordingly, it is an object of this invention to provide a new and improved railway braking apparatus for effectively retarding railway cars.

Still another object of this invention is to provide a unique low-profile railway car retarder which allows the free unimpeded passage of humped vehicles.

Still a further object of this invention is to provide a novel frictional-type of gripping railway braking apparatus which more effectively retards passing vehicles by having the brake shoes engage the sides of the wheels at a relatively higher level.

Yet another object of this invention is to provide an improved railway car retarder which is readily adjusted for compensating for brake shoe wear.

Yet a further object of this invention is to provide a new pneumatic operated car retarder having a pair of braking bars disposed parallel and on opposite sides of a track rail, an upper and a lower pivotal lever, each of the upper and lower pivotal levers having a platform portion for carrying a respective one of the pair of braking bars and having a laterally extending arm, a pneumatic piston-cylinder actuator, the piston of the pneumatic piston-cylinder actuator pivotally connected to the outer extremity of the laterally extending arm of the lower pivotal lever, the cylinder of the pneumatic piston-cylinder actuator pivotally connected to the outer extremity of the laterally extending arm of the upper pivotal lever, the height of the pivotal connection of the cylinder with the upper pivotal lever is substantially at the same level as the top of the track rail so that a railway vehicle is permitted to freely pass through the car retarder, and the pneumatic piston-cylinder actuator lifts the upper pivotal lever and depresses the lower pivotal lever for moving one pair of braking bars to a closed braking position when pressure is supplied to the pneumatic piston-cylinder actuator so that the pair of braking bars engage the opposite sides of the vehicle wheels at a relatively high point to exert an increased amount of retardation on the passing vehicle.

An additional object of this invention is to provide a new and improved railway car retarder which is economical in cost, simple in construction, dependable in service, easy to maintain, durable in use, efficient in operation, and facile to repair.

BRIEF DESCRIPTION OF THE DRAWINGS

The above objects and other attendant advantages of the present invention will become more readily apparent from the following detailed description when analyzed and considered in conjunction with the accompanying drawings, wherein:

Referring now to the drawings, and in particular to FIG. 1, there is shown a section or stretch of railway track which may be located in the hump or group area of a railroad classification yard. The trackway includes a pair of running track rails 1 and 2 which are suitably supported on usual cross-ties 3. In practice, the track rails 1 and 2 are mounted on a plurality of rail supports or chairs 4 which are securely fastened to the tops of cross-ties 3. As shown in FIG. 2, the rail support 4 is a prefabricated weldment structure having a lower base plate 5 and an upper box-like stand 6. The bearing plate 5 is situated on the top of cross-tie 3 and is bolted in place by through bolts 7. The rail 1 is disposed on top of stand 6 and is securely held in place by flange gripping members 8 which are bolted to the top of the stand 6.

As shown in FIG. 1, the braking apparatus or car retarder is disposed about each of the rails 1 and 2 so that both wheels of each axle of the railway vehicles may be simultaneously retarded to control the exiting speed of humped vehicles. It will be seen that a pair of braking bars 10 and 10' extend parallel and on opposite sides of running rail 1 while a pair of braking bars 11 and 11' extend parallel and on opposite sides of running rail 2. It will be noted that the entering ends of the braking shoes 10, 10' are offset in relation to the entering ends of the braking shoes 11, 11' to allow the wheels on rail 2 to initially enter the retarder and then to allow the wheels on rail 1 to subsequently enter the retarder for a smoother transitional ingress. In viewing FIG. 1, it will be observed that the braking bars are adapted to be moved toward and away from the respective running rails in braking and nonbraking positions by a plurality of pneumatic power operating units OU. The operating units OU for braking bars 10 and 10' are staggered in relationship to the operating unit OU for braking bars 11 and 11' which facilitates the installation and maintenance of the braking apparatus. In practice, a source of pneumatic or air pressure (not shown) is piped to the individual operating units via trunk line or conduit 12 which is connected to branch pipes 13. The branch OU via flexible conduits or metal. Each of the operating units OU is substantially identical in construction and includes a pneumatic piston-cylinder actuator or fluid motor 15 and a pair of upper and lower pivotal levers 16 and 17, respectively. The upper levers 16 carry the outer braking bars 10 and 11 while the lower lever 17 carry the inner braking bars 10' and 11'. The braking bars 10, 10' and 11, 11' consist of a series of elongated brake beams 20, and 20', and 21, 21' jointed together at their adjoining ends by an overlap connection. Each of the braking bars also includes a series of replaceable brake shoes 22, 22' and 23, 23' which are carried by the respective brake beams 20, 20' and 21, 21'. As shown in FIG. 1, the adjacent ends of the brake shoes are staggered with respect to the overlapping ends of the brake beams. Further, the track rail 1 includes an inner guide rail 24 and an outer guide rail 24' at the exiting end of the retarder while the track rail 2 includes an inner guide rail 25 and an outer guide rail 25' at the exiting end of the retarder for rerailing purposes.

Turning now to FIG. 2, there is shown one of the operating units OU of the car retarder which is illustrated in its opened nonbraking position for allowing the wheel W to pass through without any retardation or frictional braking. Each of the operating units OU includes a short-stroke pneumatic piston-cylinder actuator 15, which may be of the type shown and disclosed in our copending application Ser. No. 105,325 now continuation application Ser. No. 274,956, filed concurrently herewith, entitled Pneumatic Pressure Actuator, and a pair of pivotal levers 16 and 17. The pneumatic motor 15 includes a cylinder assemblage 26 having an upper casting 27, a lower casting 28, and an intermediate plastic casing 29 held together by a plurality of tie bolts 30. The fluid pressure motor 15 also includes an internal reciprocating piston and a piston rod 31 which extends through the lower casting 28. A pipe fitting 18 is threaded in the top of the upper casting 27 for supplying air pressure to the top of the piston by flexible conduit 14. A pipe fitting 19 is threaded in the bottom of the lower casting 28 to vent the underside of the piston to atmosphere. As shown, the outer extremity of the upper lever 16 is pivotally connected to a trunnion portion of the upper casting 27 by a pivot or fulcrum pin 32 while the outer extremity of the lower lever 17 is pivotally connected to the end of the piston rod 31 by pivot or fulcrum pin 33. The pivot pins 32 and 33 are locked in position by retaining eye-pins 34 and 35, respectively, which are bolted to the respective levers.

It will be seen that the upper and lower levers are pivoted about a common fulcrum point or pivot pin 37 carried by the associated rail supports 4 mounted on the two adjacent cross-ties 3. As shown in FIG. 2, the pivot pin 37 passes through sleeve bearings in levers 16 and 17, and the pin 37 is locked in place by retaining eye-pins 38, each of which is bolted to the respective associated rail support 4. A grease fitting 39 is provided to lubricate the mutual center bearing of the upper and lower levers 16 and 17 while grease fittings 40 and 41 are provided to lubricate the respective end bearings of upper and lower levers 16 and 17. It will be seen that the upper lever 16 initially extends upwardly and outwardly from its journaled end with pivot pin 37 and that intermediate its free end the lever 17 is bent and extends horizontally, the purpose of which will be described hereinafter. A platform structure 45 is disposed between the bifurcated arms of upper lever 16 intermediate its pivoted ends. The platform 45 is preferably a prefabricated weldment which is fixedly secured to lever 16 by fillet welding the contiguous surfaces. Also, a bored apertured spring retaining block 46 is fillet welded to each of the outside surfaces of the bifurcated lever 16 for holding the two resilient stop units SU1 and SU2. Each of the spring units includes a bolt 48 extending downwardly with some clearance through an aperture formed in the retaining block 46. A long collar unit 49 is threadedly screwed onto the lower end of the bolt 48. A biasing spring 50 surrounds the upper collar portion of nut 49 and the lower portion of bolt 48. The spring is entrapped between the flange portion of nut 49 and a circular collar provided on the underside of retaining block 46. It will be seen that the resilient spring 50 is slightly depressed by the weight of the lever assembly so that the head of the bolt 48 is spaced from the top surface 51 of block 46.

Figure 1:
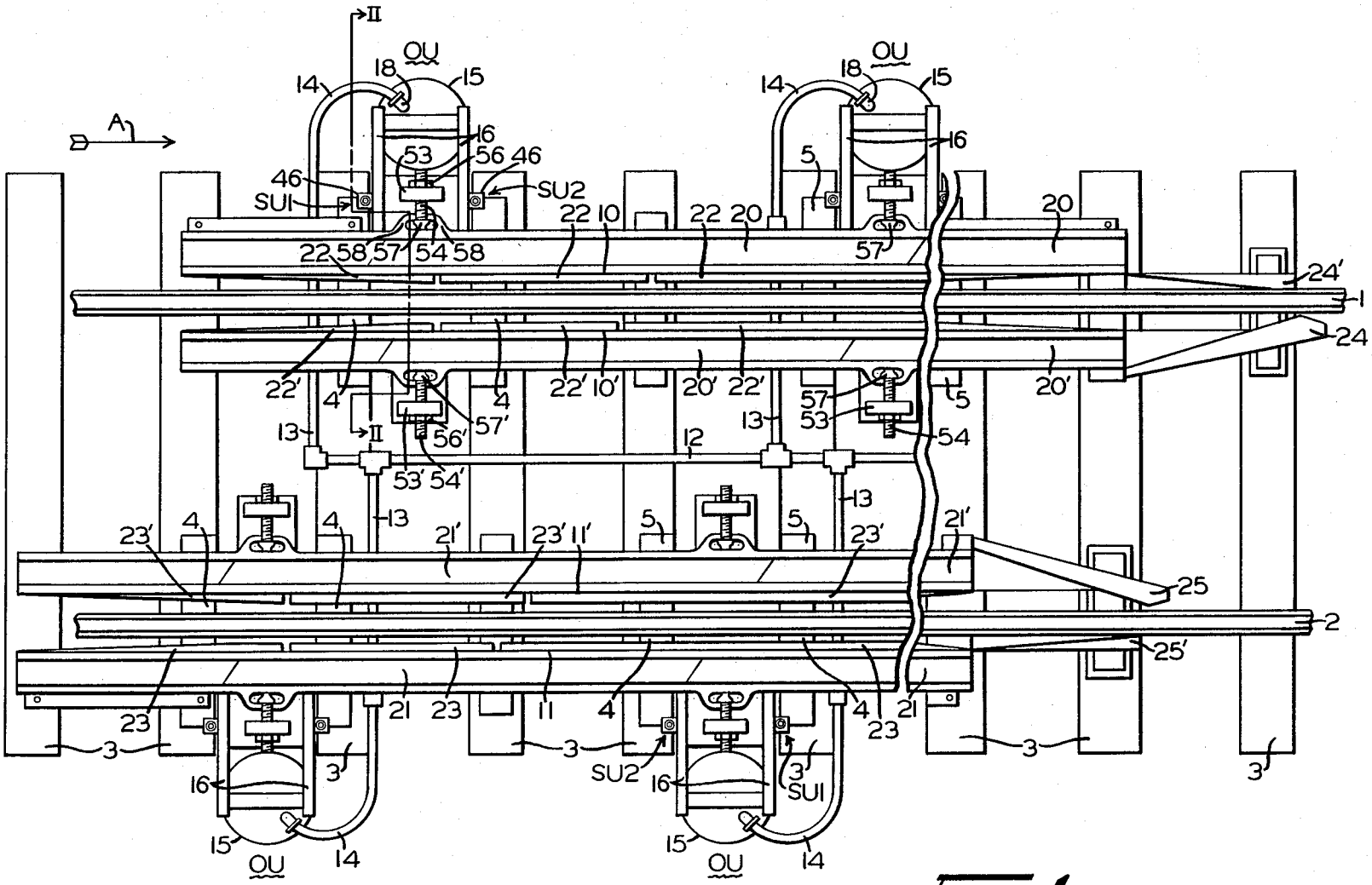
FIG. 1 is a partial top plan view showing a staggered dual track railway braking apparatus or car retarder in accordance with the present invention.

It will be seen that the upper surface of platform 45 is provided with an upstanding lug 53 which includes centrally a threaded aperture for receiving an adjusting bolt 54. The outer end of bolt 54 is provided with a hexagonal or square head 55 to facilitate turning the bolts by means of a wrench. A lock nut 56 is provided at the end of the adjusting bolt 54 to allow the bolt to be locked in place after adjustment. Further, the adjusting bolt 54 is provided with an enlarged head portion 57 which is adapted to engage and cooperate with bifurcated members or hook portions 58 provided on the outer edge of the brake beam 20. The platform 45 includes a flat upper surface 45*a* which supports the braking bar 10. As mentioned above, the braking bar 10 includes the brake beam 20 and the replaceable brake shoe 22 which is secured to the inside vertical surface by threaded bolts or the like. In viewing FIG. 2, it will be observed that the underside of the elongated brake beam 20 is provided with a pair of opposing hook portions 20*a* which are initially aligned with a pair of notches 45*b* formed in the opposite sides of the flat upper surface portion 45*a*. In practice, the adjusting bolt 54 is sufficiently backed off to allow the enlarged head 57 to be disposed between the two hook portions 58 as well as to allow the hooks to become aligned with notches 45*b*. Under this condition, the periphery of the hooks easily clears the edges of notches 45*b* to allow the brake beam 20 to be seated on the upper flat surface of the platform for allowing the brake beams 20 to be interlocked with the supporting platform 45. That is, the adjusting bolt 54 is turned to slide the braking bar 10 toward the track rail 1 so that the tongs of the hooks 20*a* will be situated under projecting ears 45*d* of platform 45.

It will be appreciated that the lower lever 17 includes a prefabricated weldment platform structure 45′ which is fixedly secured by fillet welding or the like to the remote end of the lever 17. Like platform 45, the platform support 45′ includes a flat upper surface 45*a*′ having an upstanding lug 53′ welded to the top of support 45. The lug 53′ is centrally bored and threaded to receive a screw-threaded adjusting bolt 54′ which is provided with a wrench accommodating head 55′ and a lock nut 56′. The adjusting bolt 54′ also includes an enlarged head 57′ which cooperates with hook portion 58′ to move the braking bar 10′ toward and away from the center of the track rail 1. The brake beam 20′ includes a pair of opposing hook portions 20*a*′ which are initially aligned with a pair of notches 45*b*′ and subsequently are disposed beneath projecting ears 45*d*′ to interlock the braking bar 10′ with respect to platform 45′.

Figure 2:
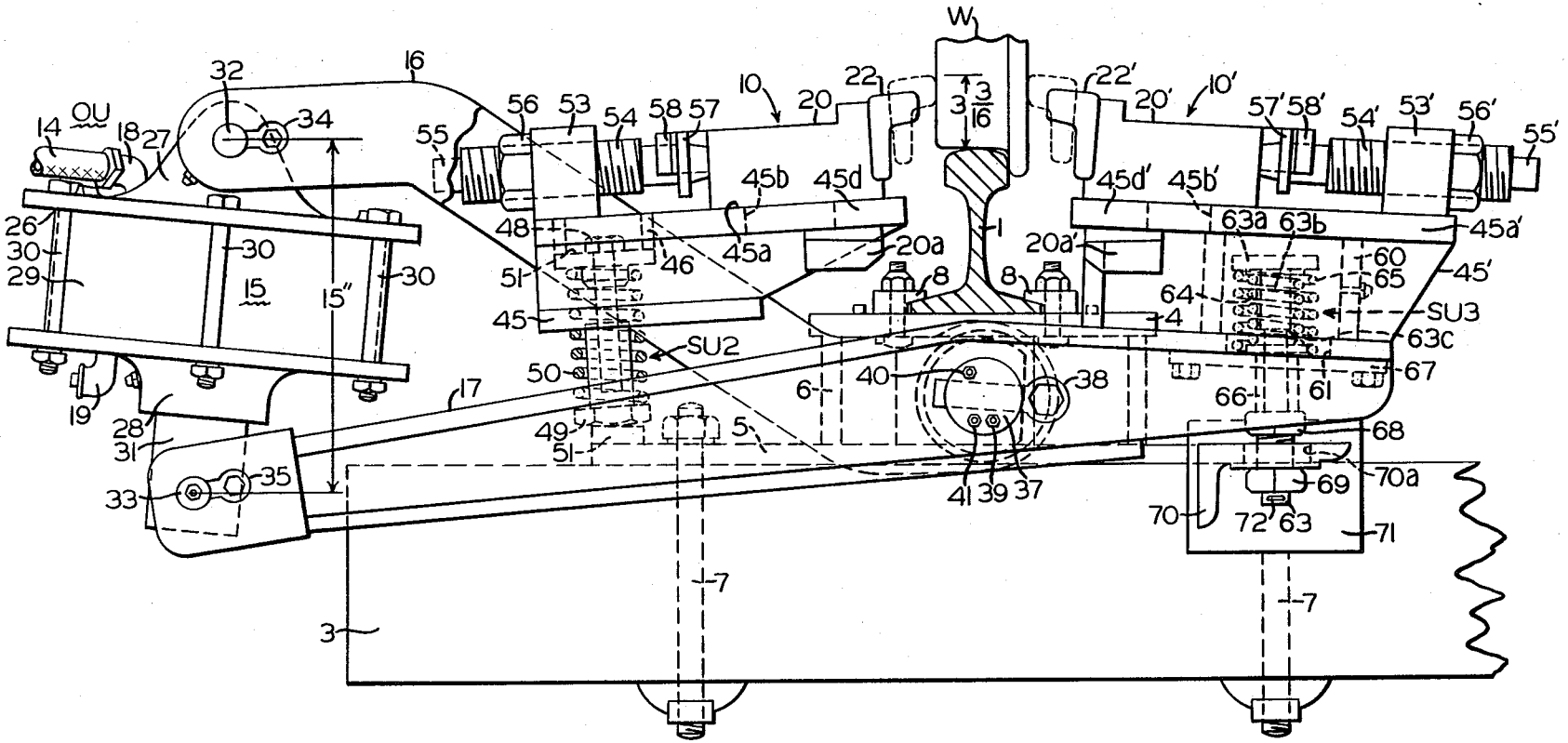
FIG. 2 is an enlarged vertical sectional view of the car retarder in its opened nonbraking position taken substantially along lines II—II of FIG. 1.

It will be seen that a resilient spring return and stop unit SU3 is also cooperatively associated with the lower lever 17. The spring unit SU3 is disposed within a fabricated housing 60 formed between the bottom side of the upper plate 45*a* and the upper side of the top plate of lever 17. A circular opening 61 is formed in the top plate of lever 17. The spring unit SU3 includes a spring bolt 63 having an enlarged circular head 63*a*, a shank 63*b*, and a shoulder 63*c*. An inner stop spring 64 and an outer return spring 65 are disposed about the shank portion of bolt 63. A flanged sleeve 66 is disposed on bolt 63. The stop spring 64 is trapped between the circular head 63*a* of bolt 63 and the shoulder 63*c*. The return spring 65 is trapped between the enlarged head 63*a* of bolt 63 and the top surface of end plate 67 which is bolted to the underside of the top plate of the lever 17. A spring stop nut 68 is threaded onto the bolt 63 while a spring lock nut 69 is also threaded onto the end of bolt 63. As shown, an L-shaped angle bracket 70 is disposed between the two adjacent cross-ties 3. An L-shaped angle iron 71 has its vertical leg welded to each end of bracket 70 and has its horizontal leg bolted to the top of cross-ties 3 by through bolts 7, one of which is shown in FIG. 2. The lower end of bolt 63 extends downwardly through a lateral elongated slot 70*a* formed in the angle bracket 70 and is secured to bracket 70 by stop nut 68 and lock nut 69 which is held in place by a cotter pin 72.

In describing the operation of the car retarder, it will i be appreciated that the braking bars 10 and 10′ are adjusted to have a six inch gap between the opposing faces of the brake shoes 22 and 22′ when the retarder is in its open nonbraking position and to have a five inch gap between the opposing wheel engaging surfaces of the brake shoes 22 and 22′ when the retarder is in its closed braking position. For adjusting the car retarder in its open position, a maintainer initially turns the heads of spring bolts 48 of spring units SU1 and SU2 which is readily exposed from the top of the retarder until the distance from the top of cross-ties 3 to the center of pivot pin 32 is fifteen inches. It will be appreciated that in the subject low-profile configuration, this distance is approximately twenty-five percent less than in previous frictional car retarders, namely, fifteen inches versus nineteen and three-quarter inches. Thus, the present low-profile car retarder is less likely to impede the free passage of humped railway cars. For example, low hanging side car ladders and corner sills will not engage the outer extremity of the upper lever 16 as was common occurrence in existing car retarders. It has been found that the railway cars sway or move from side-to-side as they negotiate their way from the crest of the hump to the storage tracks so that the lower corner side structure of the cars previously struck the upstanding ends of the upper levers of the prior art car retarders. Thus, less damage to rolling stock as well as to the retarder proper is realized due to the unique low-profile structural configuration of the present car retarder. Further, it will be appreciated that the opened and closed brake shoe distances are initially adjusted by turning the stop and lock nuts 56 and 56′ and heads 55 and 55′ of the adjusting bolts 54 and 54′. Subsequent compensation for brake shoe wear may be accomplished by turning the bolts 54 and 54′ inwardly to obtain the five inch gap in the closed braking position.

Let us assume that the car retarder is in its opened nonbraking position as shown in FIG. 2 and that it is desired Thus, fluid pressure or air is admitted from the supply source lines 12, 13, and 14 to each piston-cylinder actuator or motor 15. When the fluid pressure enters the cylinder 26, the piston begins to move downwardly causing the extension of the piston rod 31. The initial downward movement of the piston rod 31 causes the lower lever 17 to rotate in a counterclockwise direction about fulcrum pin 37 thereby raising and moving the brake shoe 22′ to its closed braking position as shown in phantom in FIG. 2. Further rotational movement of the lower lever 17 is restricted by the spring stop unit SU3. That is, when the stop spring 64 becomes fully compressed, it stops any further rotation of lever 17, and thus the cylinder 26 begins to move upwardly to cause the upper lever 16 to rotate in a clockwise direction about fulcrum pin 37. The upward movement of pivotal lever 16 causes the brake shoe 22 to rise and move the brake shoe 22 to its closed braking position as denoted by the phantom lines in FIG. 2 when the piston-cylinder actuator reaches its fully extended position. Thus, the car retarder assumes its closed braking position so that the brake shoes 22 and 22′ will engage and grip the respective sides of the wheel W or wheels of a railway car traversing the rails 1 and 2. It will be seen that the tops of the brake shoes 22 and 22′ engage the sides of the wheel W at the height of three and three-sixteenth inches from the top of running rail 1 which is effectively one-quarter inch more than existing conventional car retarders. It has been found that by increasing the height of frictional engagement by a quarter of an inch results in a ten percent increase in the retardation or braking action of the car retarder. Thus, the overall length of the car retarder may be proportionally reduced to more efficiently and effectively utilize the master and group track lengths in a hump-type of classification yard where space is generally at a premium. That is, in many classification yards, the amount of straight track lengths in the master and group areas is very limited so that it is highly advantageous to have a car retarder as short as possible yet capable of applying the required maximum braking force on the passing car wheels. It will also be appreciated that a shorter length car retarder is not only less costly to initially purchase but also less expensive to subsequently maintain and repair due to the lesser number of operating units OU and brake shoe lengths.

In viewing FIG. 1, it will be seen that when a vehicle enters the car retarder at the left as indicated by arrow A, the right wheels moving on rail 2 initially engage the brake shoes 23 and 23' and then the left wheels moving on rail 1 engage the brake shoes 22 and 22' due to the staggered arrangement of the braking bars. This staggering of the braking apparatus of rail 2 with respect to the braking apparatus of rail 1 reduces entrance shock and jolting to the entering car and its lading.

If it is now desired to move the braking bars to their nonbraking positions, it is simply necessary to exhaust the fluid or air from the piston-cylinder actuators or fluid motors 15. In viewing FIG. 2, it will be seen that under this condition, the upper lever 16 moves in a counterclockwise direction by gravity and comes to rest when the nut 49 strikes the stop boss 51 provided on the bearing plate 5. Then, the lower lever 17 moves in a clockwise direction about pivot pin 37 under the force of gravity and springs 64 and 65 and comes to rest when the piston is retracted to its fully extended position within cylinder 26. The spring stop units SU1 and lever are arranged and designed to permit the levers, motors, and associated braking bar to swing a limited amount about the fulcrum pin 37. In effect, the limited amount of swing permits the brake shoes to move or travel approximately one-half of an inch on either side of their positions so that the brake shoes may adjust themselves to the various widths of the passing car wheels when the retarder is in its braking position. Further, the brake shoes may also adjust themselves to allow the passage of all cars and locomotives when the retarder is in its nonbraking position.

Although we have herein shown and described only one form of our invention, it is understood that various changes, modifications, and alterations may be made therein within the spirit and scope of the appended claims and without departing from the spirit and scope of our invention.

Having now described the invention what we claim as new and desire to secure by Letters Patent, is:

1. A low-profile pneumatically operated car retarder comprising, a pair of braking bars disposed parallel and on opposite sides of a track rail which is mounted on crossties, an upper and a lower pivotal lever, each of said upper and lower pivotal levers having a platform portion for carrying a respective one of said pair of braking bars, said lower pivotal lever having a laterally extending arm, said upper lever initially extending upwardly and outwardly and subsequently extending outwardly to from a horizontal arm, a pneumatic piston-cylinder actuator, said piston of said pneumatic piston-cylinder actuator pivotally connected to the outer extremity of said laterally extending arm of said lower pivotal lever, said cylinder of said pneumatic piston-cylinder actuator pivotally connected to the outer extremity of said horizontal arm of said upper pivotal lever, the height of the pivotal connection of said cylinder with the outer extremity of said horizontal arm of said upper pivotal lever is approximately fifteen inches from the top of the crossties and is substantially at the same level as the top of the track rail so that a low slung railway vehicle is permitted to freely pass through the car retarder, and said pneumatic piston-cylinder actuator lifting said upper pivotal level and depressing said lower pivotal lever for moving said pair of braking bars to a closed braking position when pressure is supplied to said pneumatic piston-cylinder actuator so that said pair of braking bars engage the opposite sides of the vehicle wheels at approximately three and three sixteenth inches from the top of the running rail to exert a greater amount of retardation on the passing vehicles.

2. The low-profile pneumatically operated car retarder as defined in claim 1, wherein said horizontally extending arm of said upper pivotal lever is arranged to provide a greater amount of clearance for passing vehicle.

3. The low-profile pneumatically operated car retarder as defined in claim 2, wherein the longitudinal axis of said pneumatic piston-cylinder actuator is arranged in a near vertical disposition when said upper and lower pivotal levers are in their non-braking positions.

4. The low-profile pneumatically operated car retarder as defined in claim 1, wherein said upper and lower pivotal levers are pivoted about a fulcrum point located beneath the track rail.

5. The low-profile pneumatically operated car retarder as defined in claim 1, wherein said upper pivotal lever includes a spring-loaded stop for limiting the movement of said upper and lower pivotal levers in their open nonbraking positions.

6. The low-profile pneumatically operated car retarder as defined in claim 1, wherein said lower pivotal lever includes a spring-loaded stop for limiting the movement of said upper and lower pivotal levers in their closed braking positions.

7. The low-profile pneumatically operated car retarder as defined in claim 6, wherein said upper and lower pivotal levers are biased to the open nonbraking position by gravity and the resiliency of said spring-loaded stop of said lower pivotal lever.

8. The low-profile pneumatically operated car retarder as defined in claim 1, wherein each of said pair of braking bars includes a brake beam and a brake shoe and an adjusting bolt cooperating with said brake beam to compensate for wear on said brake shoe.

9. The low-profile pneumatically operated car retarder as defined in claim 8, wherein said brake beam includes a depending hook retaining member which fits into a slot formed in said platform portion for limiting the amount of lift of said braking bars when said brake shoes engage the sides of the vehicle wheels.

10. The low-profile pneumatically operated car retarder as defined in claim 1, wherein said pneumatic piston-cylinder actuator includes a short-stroke piston and a cylinder assemblage having a plastic casing.

11. A low-profile pneumatically operated car retarder comprising, a pair of braking bars disposed parallel and on opposite sides of a track rail, an upper and a lower pivotal lever, each of said upper and lower pivotal levers having a platform portion for carrying a respective one of said pair of braking bars, said lower pivotal lever having a laterally extending arm, said upper lever initially extending upwardly and outwardly and subsequently bent outwardly to form a horizontal arm, a pneumatic piston-cylinder actuator, said piston of said pneumatic piston-cylinder actuator pivotally connected to the outer extremity of said laterally extending arm of said lower pivotal lever, said cylinder of said pneumatic piston-cylinder actuator includes an upper casting, a lower casting and an intermediate casing which is held together by a plurality of tie bolts, said upper casting of said pneumatic piston-cylinder actuator pivotally connected to the outer extremity of said horizontal are of said upper pivotal lever, the height of the pivotal connection of said cylinder with the outer extremity of said horizontal arm of said upper pivotal lever is substantially at the same level as the top of the rail so that a low slung railway vehicle is permitted to freely pass through the car retarder, and said pneumatic piston-cylinder actuator lifting said upper pivotal lever and depressing said lower pivotal lever for moving said pair of braking bars to a closed braking position when pressure is supplied to said pneumatic piston-cylinder actuator so that said pair of braking bars engage the opposite sides of the vehicle wheels at a relatively high retardation on the passing vehicles than if said pair of braking bars engaged the opposite sides of the vehicle wheels a quarter of an inch below the high point.

* * * * *

UNITED STATES PATENT AND TRADEMARK OFFICE
CERTIFICATE OF CORRECTION

PATENT NO. : 4,867,279

DATED : September 19, 1989

INVENTOR(S) : CHARLES T. LINK, BENNIE M. GRAY, HAROLD L. SCHUMAKER

It is certified that error appears in the above-identified patent and that said Letters Patent is hereby corrected as shown below:

Column 1, line 36, change "ar" to --car--.

Column 1, line 45, after "will" insert --be appreciated that the shortening of the overall length of--.

Column 2, line 31, change "one" to --the--.

Column 3, line 27, after "branch" insert --lines or pipes are connected to the respective operating units--.

Column 3, line 28, after "metal" insert --hoses 14--.

Column 5, line 57, delete "i".

Column 6, line 27, after "desired" insert --that the retarder be moved to its closed braking position.--.

Column 6, line 28, after "source" insert --through--.

Column 7, line 25, after "and" insert --SU2 of the upper lever and spring stop unit SU3 of the lower--.

Column 8, line 39, Claim 8, delete "each of".

Column 8, line 50, Claim 10, after "said" insert --piston of said--.

Column 9, line 3, change "are" to --arm--.

Column 10, line 5, claim 11, after "high" insert --point to exert approximately ten percent greater amount of--.

UNITED STATES PATENT AND TRADEMARK OFFICE

CERTIFICATE OF CORRECTION

PATENT NO. : 4,867,279

DATED : September 19, 1989

INVENTOR(S) : CHARLES T. LINK, BENNIE M. GRAY, HAROLD L. SHUMAKER

It is certified that error appears in the above-identified patent and that said Letters Patent is hereby corrected as shown below:

Column 3, line 33, change "lever" to --levers--.

Column 8, lines 11-12, change "vehicle" to --vehicles--.

Column 8, line 51, change "includes" to --is--.

Column 8, line 52, after "and" insert --said cylinder is part of--.

Signed and Sealed this

Twenty-third Day of February, 1993

*Attest:*

STEPHEN G. KUNIN

*Attesting Officer*

*Acting Commissioner of Patents and Trademarks*